US006824220B1

(12) United States Patent
Davison

(10) Patent No.: US 6,824,220 B1
(45) Date of Patent: Nov. 30, 2004

(54) MODULAR FURNITURE RETAINING SYSTEM

(76) Inventor: Gregory P. Davison, 222 E. 27th St., Apt. 16, New York, NY (US) 10016

( * ) Notice: Subject to any disclaimer, the term of this patent is extended or adjusted under 35 U.S.C. 154(b) by 0 days.

(21) Appl. No.: 10/741,543

(22) Filed: Dec. 19, 2003

(51) Int. Cl.[7] ..... A47C 7/00
(52) U.S. Cl. ..... 297/440.14; 297/233
(58) Field of Search ..... 297/440.14, 233, 297/248

(56) References Cited

U.S. PATENT DOCUMENTS 2,087,574 A * 7/1937 Kaufer ..... 297/113
2,264,491 A * 12/1941 Ward ..... 297/233
2,793,685 A * 5/1957 Spitz ..... 297/411.27
3,635,521 A 1/1972 Shivvers
3,714,906 A 2/1973 Finestone
3,973,800 A 8/1976 Kogan
4,077,666 A * 3/1978 Heumann ..... 297/440.14
4,325,597 A * 4/1982 Morrison ..... 312/258
5,125,202 A * 6/1992 Kissinger ..... 52/239

FOREIGN PATENT DOCUMENTS

GB 2226236 * 6/1990

* cited by examiner

*Primary Examiner*—Milton Nelson, Jr.

(57) ABSTRACT

A modular furniture retaining system for maintaining a static relationship between multiple related pieces of furniture. The modular furniture retaining system includes a first piece of modular furniture, a second piece of modular furniture, a first magnetic coupling assembly and a second magnetic coupling assembly. The first piece of modular furniture includes a first side and a second side. Similarly the second piece of modular furniture includes a third side and a fourth side. The first magnetic coupling assembly has a first polarity, and is positioned on the first side of the first piece of modular furniture. Similarly, the second magnetic coupling assembly has a second polarity complimentary to the first polarity of the first magnetic coupling assembly. The second magnetic coupling assembly is positioned to align with the first magnetic coupling assembly when the third side abuts the first side.

20 Claims, 3 Drawing Sheets

MODULAR FURNITURE RETAINING SYSTEM

BACKGROUND OF THE INVENTION

1. Field of the Invention

The present invention relates to modular furniture and more particularly pertains to a new modular furniture retaining system for maintaining a static relationship between multiple related pieces of furniture.

2. Description of the Prior Art

The use of modular furniture is known in the prior art. U.S. Pat. No. 3,973,800 describes a system using interconnecting hooking devices to secure modular pieces of furniture together. Another type of modular furniture is U.S. Pat. No. 3,635,521 having a folding modular construction providing a variety of configurations.

While these devices fulfill their respective, particular objectives and requirements, the need remains for a system that is superior in maintaining positioning of related pieces of furniture with respect to one another.

SUMMARY OF THE INVENTION

The present invention meets the needs presented above by using magnetic coupling assemblies to selectively couple related pieces of furniture together.

Another object of the present invention is to provide a new modular furniture retaining system that allows furniture to be quickly reconfigured without the use of tools.

Still another object of the present invention is to provide a new modular furniture retaining system that allows large groupings to be moved as smaller individual pieces thereby expanding the size of groupings which may be moved into a room through a doorway, hallway or around an obstruction.

To this end, the present invention generally comprises includes a first piece of modular furniture, a second piece of modular furniture, a first magnetic coupling assembly and a second magnetic coupling assembly. The first piece of modular furniture includes a first side and a second side. Similarly the second piece of modular furniture includes a third side and a fourth side. The first magnetic coupling assembly has a first polarity, and is positioned on the first side of the first piece of modular furniture. Similarly, the second magnetic coupling assembly has a second polarity complimentary to the first polarity of the first magnetic coupling assembly. The second magnetic coupling assembly is positioned to align with the first magnetic coupling assembly when the third side abuts the first side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
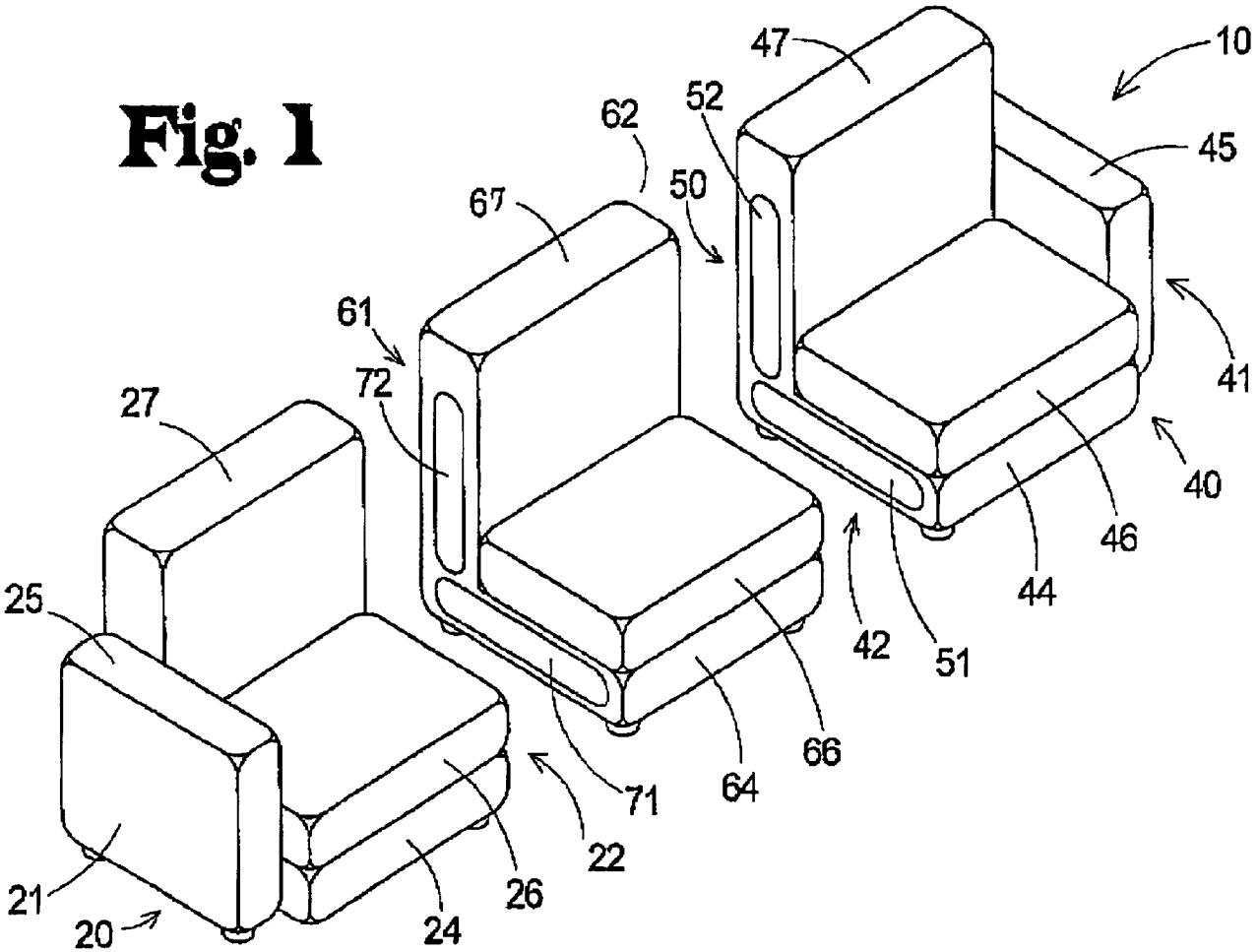
FIG. 1 is a schematic perspective view of a new modular furniture retaining system according to the present invention.
Figure 2:
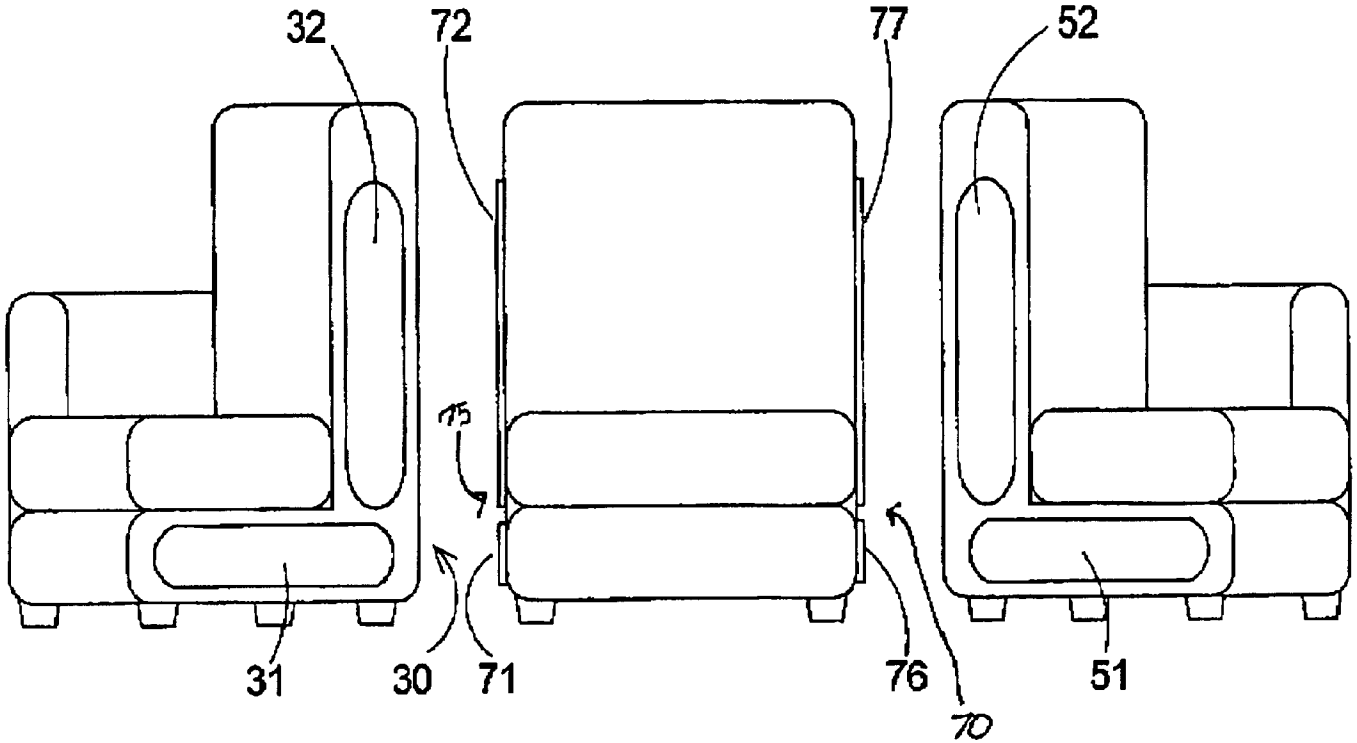
FIG. 2 is a schematic side view of the present invention.
Figure 3:
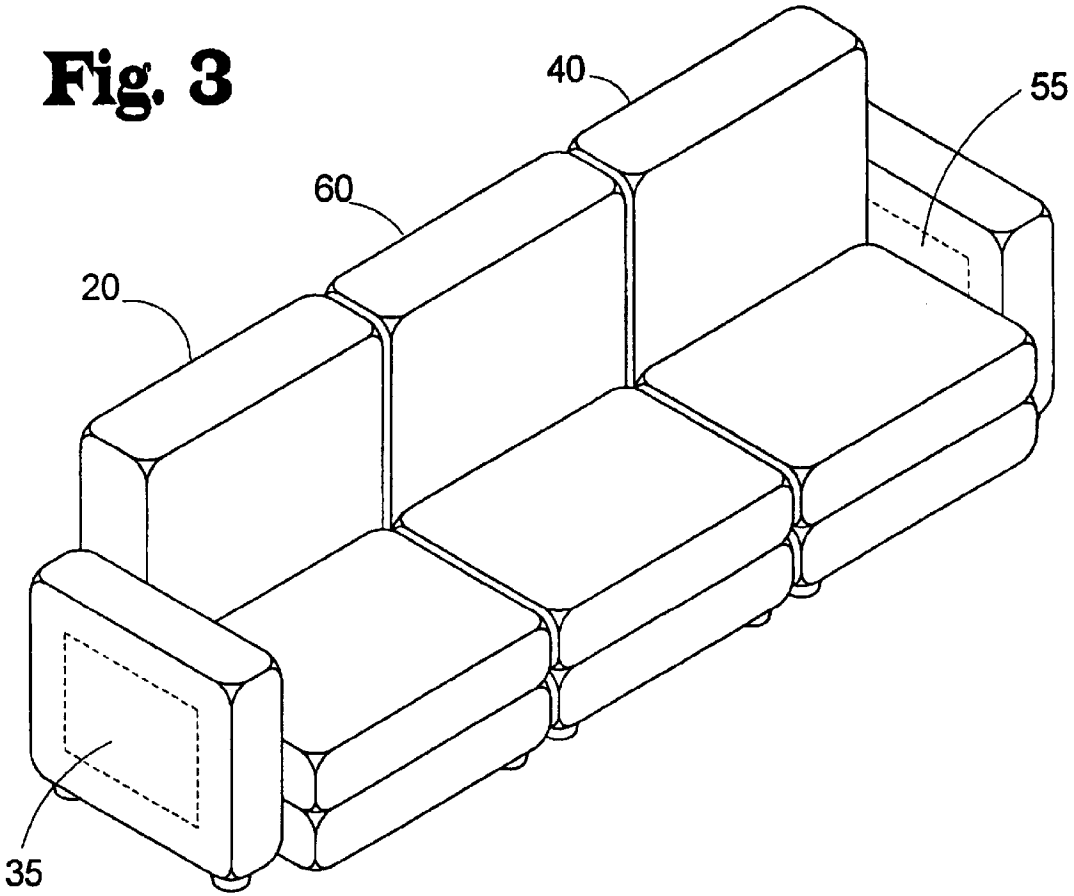
FIG. 3 is a schematic perspective view of an embodiment of the present invention.

With reference now to the drawings, and in particular to FIGS. 1 through 3 thereof, a new modular furniture retaining system embodying the principles and concepts of the present invention and generally designated by the reference numeral 10 will be described.

As best illustrated in FIGS. 1 through 3, the modular furniture retaining system 10 generally comprises a first piece of modular furniture 20, a second piece of modular furniture 40, a first magnetic coupling assembly 30 and a second magnetic coupling assembly 50.

The first piece of modular furniture 20 includes a first side 21 and a second side 22. Similarly the second piece of modular furniture 40 includes a third side 41 and a fourth side 42.

The first magnetic coupling assembly 30 has a first polarity, and is positioned on the first side 21 of the first piece of modular furniture 20. Similarly, the second magnetic coupling assembly 50 has a second polarity complimentary to the first polarity of the first magnetic coupling assembly 30. The second magnetic coupling assembly 50 is positioned on the third side 41 of the second piece 40 of modular furniture. The second magnetic coupling assembly 50 is positioned to align with the first magnetic coupling assembly 30 when the third side 41 abuts the first side 21.

The first magnetic coupling assembly 30 and the second magnetic coupling assemblies 40 are for selectively coupling the first piece of modular furniture 20 to the second piece of magnetic furniture 40.

In an embodiment, a third magnetic coupling assembly 35 includes a second polarity complimentary to the first polarity of the first magnetic coupling assembly 30. The third magnetic coupling assembly 35 is positioned on the second side 22 of the first piece of modular furniture 20. The third magnetic coupling assembly 35 is positioned to align with the second magnetic coupling assembly 50 when the third side 41 abuts the second side 22. Additionally, a fourth magnetic coupling assembly 55 includes a first polarity complimentary to the second polarity of the second magnetic coupling assembly 50. The fourth magnetic coupling assembly 55 is positioned on the fourth side 42 of the second piece of modular furniture 40. The fourth magnetic coupling assembly 55 is positioned to align with the third magnetic coupling assembly 35 when the fourth side 42 abuts the second side 22.

A preferred embodiment includes at least one tertiary piece of modular furniture 60. The tertiary piece of modular furniture 60 includes a tertiary first side 61 and a tertiary second side 62, a tertiary first polarity magnetic coupling assembly 70 and a tertiary second polarity magnetic coupling assembly 75. The tertiary first polarity magnetic coupling assembly 70 has an identical polarity to the first polarity of the first magnetic coupling assembly 30. The tertiary first polarity magnetic coupling assembly 70 is positioned on the tertiary first side 61 of the tertiary piece of modular furniture 60. Similarly, the tertiary second polarity magnetic coupling assembly 75 includes an identical polarity to the second polarity of the second magnetic coupling assembly 50. Each one of the tertiary second polarity magnetic coupling assemblies 75 is positioned on a tertiary second side 62 of the tertiary piece of modular furniture 60. The tertiary first polarity magnetic coupling assembly 70 is positioned to align with the second magnetic coupling assembly 50 when the associated tertiary first side 61 abuts the third side 41 of the second piece of modular furniture 40. The tertiary second polarity magnetic coupling assembly 75 is positioned to align with the first magnetic coupling assembly 30 when the associated tertiary second side 62 abuts the first side 21 of the first piece of modular furniture 20.

In a further embodiment the first piece of modular furniture 20 is a right end of a sectional couch, the second piece of modular furniture 40 is a left end of the sectional couch, and the tertiary piece of modular furniture 60 is a center portion of the sectional couch.

In still a further embodiment the first piece of modular furniture 20 comprises a base portion 24, a right arm portion 25, a seat portion 26, and a back portion 27. The base portion 24 is preferably designed for resting on a horizontal support surface. The right arm portion 25 is designed for supporting an arm of a user. The right arm portion 25 is operationally coupled to the base portion 24. The seat portion 26 is designed for supporting a lower portion of the user. The seat portion 26 is operationally coupled to the base portion 24. The back portion 27 provides vertical support for an upper portion of the user. The back portion 27 is operationally coupled to the base portion 24.

In yet a further embodiment the first magnetic coupling assembly 30 further comprises a seat portion magnetic member 31 operationally coupled to a first side of the seat portion 26; and a back portion magnetic member 32 operationally coupled to a first side of the back portion 27.

In still yet a further embodiment the second piece of modular furniture comprises a second base portion 44, a left arm portion 45, a second seat portion 46, and a second back portion 47. The second base portion 44 is designed for resting on a horizontal support surface. The left arm portion 45 is designed for supporting an arm of a user. The left arm portion 45 is operationally coupled to the second base portion 44. The second seat portion 46 is designed for supporting a lower portion of the user. The second seat portion 46 is operationally coupled to the second base portion 44. The second back portion 47 provides vertical support for an upper portion of the user. The second back portion 47 is operationally coupled to the second base portion 44.

In even still a further embodiment the second magnetic coupling assembly 50 further comprises a second seat portion magnetic member 51 operationally coupled to a third side of the second seat portion 46; and a second back portion magnetic member 52 operationally coupled to a third side of the second back portion 47.

In an embodiment the tertiary piece of modular furniture comprises a tertiary base portion 64, tertiary back portion 67, and a tertiary seat portion 66. The tertiary base portion 64 is designed for resting on a horizontal support surface. The tertiary seat portion 66 is designed for supporting a lower portion of the user. The tertiary seat portion 66 is operationally coupled to the tertiary base portion 64. The tertiary back portion 67 provides vertical support for an upper portion of the user. The tertiary back portion 67 is operationally coupled to the tertiary base portion 64.

In a further embodiment the tertiary first magnetic coupling assembly 70 further comprises a tertiary first seat portion magnetic member 71 operationally coupled to a tertiary first side of the tertiary seat portion 66; and a tertiary first back portion magnetic member 72 operationally coupled to a first side of the tertiary back portion 67.

In still a further embodiment the tertiary second magnetic coupling assembly 75 further comprises a tertiary second seat portion magnetic member 76 operationally coupled to a tertiary second side of the tertiary seat portion 66; and a tertiary second back portion magnetic member 77 operationally coupled to a second side of the tertiary back portion 67.

Each of the pieces of modular furniture need not be homogenous in characteristics. A first piece of modular furniture may be a seat, while a second piece may be a desk, table, hassock, or any other piece of furniture, which may be desired to be selectively coupled to a first piece of modular furniture. Further, tables, book cases, storage units, and other accessory type pieces may be built in a modular fashion and coupled together as described above.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular furniture retaining system comprising:

a first piece of modular furniture having a first side and a second side;

a first magnetic coupling assembly having a first polarity, said first magnetic coupling assembly being positioned on said first side of said first piece of modular furniture;

a second piece of modular furniture having a third side and a fourth side;

a second magnetic coupling assembly having a second polarity complimentary to said first polarity of said first magnetic coupling assembly, said second magnetic coupling assembly being positioned on said third side of said second piece of modular furniture, said second magnetic coupling assembly being positioned to align with said first magnetic coupling assembly when said third side abuts said first side;

said first magnetic coupling assembly and said second magnetic coupling assembly being for selectively coupling said first piece of modular furniture to said second piece of modular furniture;

a plurality of tertiary pieces of modular furniture, each one of said plurality of tertiary pieces of modular furniture having a tertiary first side and a tertiary second side;

a plurality of tertiary first polarity magnetic coupling assemblies each having a polarity identical to said first polarity of said first magnetic coupling assembly, each one of said plurality of tertiary first polarity magnetic coupling assemblies being positioned on a tertiary first side of an associated one of said plurality of tertiary pieces of modular furniture;

a plurality of tertiary second polarity magnetic coupling assemblies each having a polarity identical to said second polarity of said second magnetic coupling assembly, each one of said plurality of tertiary second polarity magnetic coupling assemblies being positioned on a tertiary second side of associated one of said plurality of tertiary pieces of modular furniture;

each one of said plurality of tertiary first polarity magnetic coupling assemblies being positioned to align with said second magnetic coupling assembly when said associated tertiary first side abuts said third side of said second piece of modular furniture; and each one of said plurality of tertiary second polarity magnetic coupling assemblies being positioned to align with said first magnetic coupling assembly when said associated tertiary second side abuts said first side of said first piece of modular furniture.

2. The system of claim 1, further comprising a third magnetic coupling assembly having said second polarity complimentary to said first polarity of said first magnetic coupling assembly, said third magnetic coupling assembly being positioned on said second side of said first piece of modular furniture, said third magnetic coupling assembly being positioned to align with said second magnetic coupling assembly when said third side abuts said second side.

3. The system of claim 1, further comprising a fourth magnetic coupling assembly having said first polarity complimentary to said second polarity of said second magnetic coupling assembly, said fourth magnetic coupling assembly being positioned on said fourth side of said second piece of modular furniture, said fourth magnetic coupling assembly being positioned to align with said third magnetic coupling assembly when said fourth side abuts said second side.

4. The system of claim 1, further comprising:

a third magnetic coupling assembly having a second polarity complimentary to said first polarity of said first magnetic coupling assembly, said third magnetic coupling assembly being positioned on said second side of said first piece of modular furniture, said third magnetic coupling assembly being positioned to align with said second magnetic coupling assembly when said third side abuts said second side; and a fourth magnetic coupling assembly having a first polarity complimentary to said second polarity of said second magnetic coupling assembly, said fourth magnetic coupling assembly being positioned on said fourth side of said second piece of modular furniture, said fourth magnetic coupling assembly being positioned to align with said third magnetic coupling assembly when said fourth side abuts said second side.

5. The system of claim 4, wherein said first piece of modular furniture being a right end of a sectional couch, said second piece of modular furniture being a left end of said sectional couch, and said tertiary piece of modular furniture being a center portion of said sectional couch.

6. The system of claim 5, wherein said tertiary piece of modular furniture comprises:

a tertiary base portion adapted for resting on a horizontal support surface;

a tertiary seat portion adapted for supporting a lower portion of a user, said tertiary seat portion being operationally coupled to said tertiary base portion; and a tertiary back portion providing vertical support for an upper portion of the user, said tertiary back portion being operationally coupled to said tertiary base portion.

7. The system of claim 6, wherein said tertiary first magnetic coupling assembly further comprises:

a tertiary first seat portion magnetic member operationally coupled to a tertiary first side of said tertiary seat portion; and a tertiary first back portion magnetic member operationally coupled to a first side of said tertiary back portion.

8. The system of claim 6, wherein said tertiary second magnetic coupling assembly further comprises:

a tertiary second seat portion magnetic member operationally coupled to a tertiary second side of said tertiary seat portion; and a tertiary second back portion magnetic member operationally coupled to a second side of said tertiary back portion.

9. The system of claim 5, wherein said first piece of modular furniture comprises:

a base portion adapted for resting on a horizontal support surface;

a right arm portion adapted for supporting an arm of a user, said right arm portion being operationally coupled to said base portion;

a seat portion adapted for supporting a lower portion of the user, said seat portion being operationally coupled to said base portion; and a back portion, said back portion providing vertical support for an upper portion of the user, said back portion being operationally coupled to said base portion.

10. The system of claim 9, wherein said first magnetic coupling assembly further comprises:

a seat portion magnetic member operationally coupled to a first side of said seat portion; and a back portion magnetic member operationally coupled to a first side of said back portion.

11. The system of claim 5, wherein said second piece of modular furniture comprises:

a second base portion adapted for resting on a horizontal support surface;

a left arm portion adapted for supporting an arm of a user, said left arm portion being operationally coupled to said second base portion;

a second seat portion adapted for supporting a lower portion of the user, said second seat portion being operationally coupled to said second base portion; and a second back portion providing vertical support for an upper portion of the user, said second back portion being operationally coupled to said second base portion.

12. The system of claim 11, wherein said second magnetic coupling assembly further comprises:

a second seat portion magnetic member operationally coupled to a third side of said second seat portion; and a second back portion magnetic member operationally coupled to a third side of said second back portion.

13. The system of claim 5, further comprising:

wherein said first piece of modular furniture comprises:

a base portion adapted for resting on a horizontal support surface;

a right arm portion adapted for supporting an arm of a user, said right arm portion being operationally coupled to said base portion;

a seat portion adapted for supporting a lower portion of the user, said seat portion being operationally coupled to said base portion;

a back portion said back portion providing vertical support for an upper portion of the user, said back portion being operationally coupled to said base portion;

wherein said first magnetic coupling assembly further comprises:

a seat portion magnetic member operationally coupled to a first side of said seat portion; and a back portion magnetic member operationally coupled to a first side of said back portion;

wherein said second piece of modular furniture comprises:

a second base portion adapted for resting on a horizontal support surface;

a left arm portion adapted for supporting an arm of a user, said left arm portion being operationally coupled to said second base portion;

a second seat portion adapted for supporting a lower portion of the user, said second seat portion being operationally coupled to said second base portion;

a second back portion providing vertical support for an upper portion of the user, said second back portion being operationally coupled to said second base portion;

wherein said second magnetic coupling assembly further comprises:

a second seat portion magnetic member operationally coupled to a third side of said second seat portion;

a second back portion magnetic member operationally coupled to a third side of said second back portion;

wherein said tertiary piece of modular furniture comprises:

a tertiary base portion adapted for resting on a horizontal support surface;

a tertiary seat portion adapted for supporting a lower portion of the user, said tertiary seat portion being operationally coupled to said tertiary base portion;

a tertiary back portion providing vertical support for an upper portion of the user, said tertiary back portion being operationally coupled to said tertiary base portion;

wherein said tertiary first magnetic coupling assembly further comprises:

a tertiary first seat portion magnetic member operationally coupled to a tertiary first side of said tertiary seat portion;

a tertiary first back portion magnetic member operationally coupled to a first side of said tertiary back portion;

wherein said tertiary second magnetic coupling assembly further comprises:

a tertiary second scat portion magnetic member operationally coupled to a tertiary second side of said tertiary scat portion; and a tertiary second back portion magnetic member operationally coupled to a second side of said tertiary back portion.

14. A modular furniture retaining system comprising:

a first piece of modular furniture having a first side and a second side;

a first magnetic coupling assembly having a first polarity, said first magnetic coupling assembly being positioned on said first side of said first piece of modular furniture;

a second piece of modular furniture having a third side and a fourth side;

a second magnetic coupling assembly having a second polarity complimentary to said first polarity of said first magnetic coupling assembly, said second magnetic coupling assembly being positioned on said third side of said second piece of modular furniture, said second magnetic coupling assembly being positioned to align with said first magnetic coupling assembly when said third side abuts said first side;

said first magnetic coupling assembly and said second magnetic coupling assembly being for selectively coupling said first piece of modular furniture to said second piece of modular furniture;

a third magnetic coupling assembly having a second polarity complimentary to said first polarity of said first magnetic coupling assembly, said third magnetic coupling assembly being positioned on said second side of said first piece of modular furniture, said third magnetic coupling assembly being positioned to align with said second magnetic coupling assembly when said third side abuts said second side;

a fourth magnetic coupling assembly having a first polarity complimentary to said second polarity of said second magnetic coupling assembly, said fourth magnetic coupling assembly being positioned on said fourth side of said second piece of modular furniture, said fourth magnetic coupling assembly being positioned to align with said third magnetic coupling assembly when said fourth side abuts said second side;

at least one tertiary piece of modular furniture, said tertiary piece of modular furniture having a tertiary first side and a tertiary second side;

at least one tertiary first polarity magnetic coupling assembly having a polraity identical to said first polarity of said first magnetic coupling assembly, said tertiary first polarity magnetic coupling assembly being positioned on said tertiary first side of said tertiary piece of modular furniture;

at least one tertiary second polarity magnetic coupling assembly having a polarity identical to said second polarity of said second magnetic coupling assembly, each one of said tertiary second polarity magnetic coupling assemblies being positioned on a tertiary second side of said tertiary piece of modular furniture;

said tertiary first polarity magnetic coupling assembly being positioned to align with said second magnetic coupling assembly when said associated tertiary first side abuts said third side of said second piece of modular furniture;

said tertiary second polarity magnetic coupling assembly being positioned to align with said first magnetic coupling assembly when said associated tertiary second side abuts said first side of said first piece of modular furniture;

wherein said first piece of modular furniture being a right end of a sectional couch, said second piece of modular furniture being a left end of said sectional couch, and said tertiary piece of modular furniture being a center portion of said sectional couch;

wherein said tertiary piece of modular furniture comprises:

a tertiary base portion adapted for resting on a horizontal support surface;

a tertiary seat portion adapted for supporting a lower portion of a user, said tertiary seat portion being operationally coupled to said tertiary base portion; and a tertiary back portion providing vertical support for an upper portion of the user, said tertiary back portion being operationally coupled to said tertiary base portion.

15. The system of claim 14, wherein said tertiary first magnetic coupling assembly further comprises:

a tertiary first seat portion magnetic member operationally coupled to a tertiary first side of said tertiary seat portion; and a tertiary first back portion magnetic member operationally coupled to a first side of said tertiary back portion.

16. The system of claim 14, wherein said tertiary second magnetic coupling assembly further comprises:

a tertiary second seat portion magnetic member operationally coupled to a tertiary second side of said tertiary seat portion; and a tertiary second back portion magnetic member operationally coupled to a second side of said tertiary back portion.

17. A modular furniture retaining system comprising:

a first piece of modular furniture having a first side and a second side;

a first magnetic coupling assembly having a first polarity, said first magnetic coupling assembly being positioned on said first side of said first piece of modular furniture;

a second piece of modular furniture having a third side and a fourth side;

a second magnetic coupling assembly having a second polarity complimentary to said first polarity of said first magnetic coupling assembly, said second magnetic coupling assembly being positioned said third side of said second piece of modular furniture, said second magnetic coupling assembly being positioned to align with said first magnetic coupling assembly when said third side abuts said first side;

said first magnetic coupling assembly and said second magnetic coupling assembly being for selectively coupling said first piece of modular furniture to said second piece of modular furniture;

a third magnetic coupling assembly having a second polarity complimentary to said first polarity of said first magnetic coupling assembly, said third magnetic coupling assembly being positioned on said second side of said first piece of modular furniture, said third magnetic coupling assembly being positioned to align with said second magnetic coupling assembly when said third side abuts said second side;

a fourth magnetic coupling assembly having a first polarity complimentary to said second polarity of said second magnetic coupling assembly, said fourth magnetic coupling assembly being positioned on said fourth side of said second piece of modular furniture, said fourth magnetic coupling assembly being positioned to align with said third magnetic coupling assembly when said fourth side abuts said second side;

at least one tertiary piece of modular furniture, said tertiary piece of modular furniture having a tertiary first side and a tertiary second side;

at least one tertiary first polarity magnetic coupling assembly having a polarity identical to said first polarity of said first magnetic coupling assembly, said tertiary first polarity magnetic coupling assembly being positioned on said tertiary first side of said tertiary piece of modular furniture;

at least one tertiary second polarity magnetic coupling assembly having a polarity identical to said second polarity of said second magnetic coupling assembly, each one of said tertiary second polarity magnetic coupling assemblies being positioned on a tertiary second side of said tertiary piece of modular furniture;

said tertiary first polarity magnetic coupling assembly being positioned to align with said second magnetic coupling assembly when said associated tertiary first side abuts said third side of said second piece of modular furniture;

said tertiary second polarity magnetic coupling assembly being positioned to align with said first magnetic coupling assembly when said associated tertiary second side abuts said first side of said first piece of modular furniture;

wherein said first piece of modular furniture being a right end of a sectional couch, said second piece of modular furniture being a left end of said sectional couch, and said tertiary piece of modular furniture being a center portion of said sectional couch;

wherein said first piece of modular furniture comprises:

a base portion adapted for resting on a horizontal support surface;

a right arm portion adapted for supporting an arm of a user, said right arm portion being operationally coupled to said base portion;

a seat portion adapted for supporting a lower portion of the user, said seat portion being operationally coupled to said base portion; and a back portion, said back portion providing vertical support for an upper portion of the user, said back portion being operationally coupled to said base portion.

18. The system of claim 17, wherein said first magnetic coupling assembly further comprises:

a seat portion magnetic member operationally coupled to a first side of said seat portion; and a back portion magnetic member operationally coupled to a first side of said back portion.

19. The system of claim 17, wherein said second piece of modular furniture comprises:

a second base portion adapted for resting on a horizontal support surface;

a left arm portion adapted for supporting an arm of a user, said left arm portion being operationally coupled to said second base portion;

a second seat portion adapted for supporting a lower portion of the user, said second seat portion being operationally coupled to said second base portion; and a second back portion providing vertical support for an upper portion of the user, said second back portion being operationally coupled to said second base portion.

20. The system of claim 19, wherein said second magnetic coupling assembly further comprises:

a second seat portion magnetic member operationally coupled to a third side of said second seat portion; and a second back portion magnetic member operationally coupled to a third side of said second back portion.

* * * * *